United States Patent [19]

Spies

[11] 4,185,940

[45] Jan. 29, 1980

[54] METHOD AND SYSTEM FOR SUPPORTING A ROOF

[76] Inventor: Klaus Spies, Oberholte 29, 46 Dortmund, Fed. Rep. of Germany

[21] Appl. No.: 850,096

[22] Filed: Nov. 8, 1977

[51] Int. Cl.[2] ..... E21D 23/04

[52] U.S. Cl. ..... 405/288; 248/354 R; 405/239

[58] Field of Search ..... 61/45 C, 45 R, 35, 53.62, 61/51, 54; 248/354 R, 357; 52/744, 632; 405/150, 288, 239, 258, 211, 230

[56] References Cited

U.S. PATENT DOCUMENTS

| | | | |
|---|---|---|---|
| 2,322,855 | 6/1943 | Lenahan | 61/51 |
| 2,451,777 | 10/1948 | Salas | 61/51 X |
| 2,930,199 | 3/1960 | Jarund | 61/45 B |
| 2,956,643 | 10/1960 | Halstead | 248/354 R |
| 3,292,892 | 12/1966 | Abbott | 248/354 R |
| 3,594,973 | 7/1971 | Archer | 52/632 |
| 3,690,110 | 9/1972 | Wiswell, Jr. | 61/54 |
| 3,861,155 | 1/1975 | Steinberg | 61/45 B |

FOREIGN PATENT DOCUMENTS

| | | | |
|---|---|---|---|
| 212189 | 9/1966 | Sweden | 61/54 |
| 653223 | 5/1951 | United Kingdom | 61/53.62 |
| 483528 | 12/1975 | U.S.S.R. | 61/45 C |

*Primary Examiner*—Mervin Stein
*Attorney, Agent, or Firm*—Michael J. Striker

[57] ABSTRACT

A plurality of hollow prop casings are provided which are each composed of at least two telescopable sections. These sections are erected by putting them upright and are then telescoped apart until they bear upon the roof to be supported. They are then temporarily arrested in this position and filled with a hardenable substance in flowable condition which, when it hardens, forms a solid column that is able to support the roof. Reinforcing bars or similar elements may be provided in the interior of the prop casings to become embedded in the hardenable substance. Measures may be taken for facilitating disassembly of the prop casings with the solid columns therein, under circumstances in which the casings are subjected to downward pressure by the roof.

37 Claims, 12 Drawing Figures

FIG.7
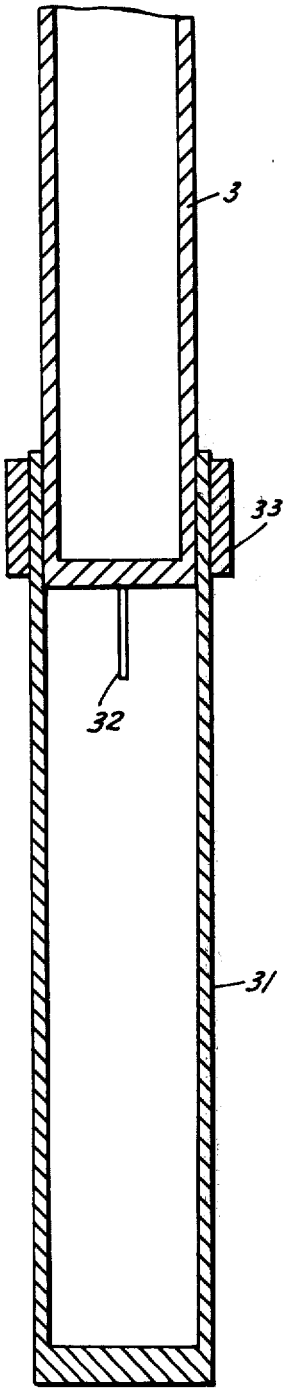
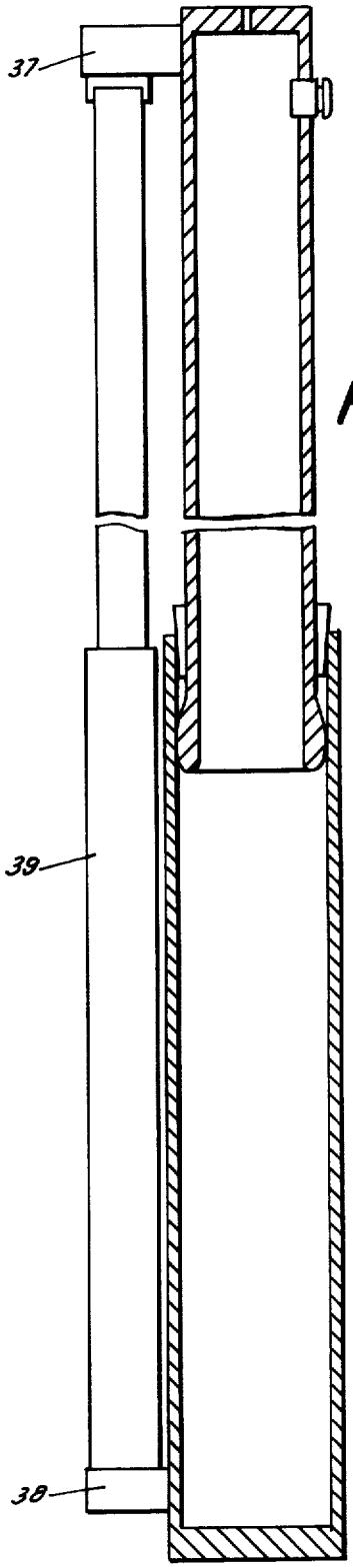
FIG.9

METHOD AND SYSTEM FOR SUPPORTING A ROOF

BACKGROUND OF THE INVENTION

1. Field of the Invention

The present invention is directed to a method of supporting a roof, particularly a roof of an underground excavation such as a mine.

The invention is also directed to a system for carrying out the method, i.e. to apparatus for this purpose.

2. The Prior Art

Particularly in the field of underground excavations, for example in the construction of mining galleries, tunnels and the like, it is usually necessary to support the roof of the excavation against caving in. Various approaches for effecting such support are known from the prior art. For example it is known in coal mining particularly to use the so-called "room and pillar system" in which roof bolting is used, i.e. steel rods or bars which penetrate the rock layers and hold them together to prevent collapse. It is also known to provide various types of supporting structures of wood and/or steel in which rigid or slightly yieldable supporting elements are used to support the roof from below against collapse.

The problem with this latter type of approach, to which the present invention is also directed, is that the prior-art proposals are all relatively complicated and expensive and are difficult to erect and to remove. The elements involved are relatively expensive and of considerable weight so that they are difficult to handle.

SUMMARY OF THE INVENTION

Accordingly, it is an object of the present invention to overcome the disadvantages of the prior art.

More particularly, it is an object of the present invention to provide an improved method of supporting a roof, particularly a roof of an underground excavation such as a mine, which method is not possessed of the prior-art drawbacks.

A concomitant object of the invention is to provide such as improved method which allows the handling and installation of the support elements in a simpler and quicker manner than heretofore possible.

Another object of the invention is to provide such a method which facilitates the erection of roof supports and reduces the costs involved therein.

A further object of the invention is to provide an improved system (e.g. arrangement) for supporting a roof, particularly a roof of an underground excavation such as a mine.

The improved system is to be simpler and less expensive to construct than those of the prior art.

An additional object of the invention is to provide such an improved system which utilizes support elements that can be readily moved and installed because they are light in weight.

A concomitant object of the invention is to provide such a system wherein the support elements are inexpensive.

In keeping with these objects, and with others which will become apparent hereafter, one feature of the invention resides in a method of supporting a roof, particularly a roof of an underground excavation such as a mine. Briefly stated, the method may comprise the steps of providing a hollow prop casing composed of at least two telescopable sections, erecting the prop casing and telescoping it apart until it bears upon the roof to be supported, arresting the sections of the prop casing in the telescoped-apart position, and filling the prop casing with a hardenable substance in flowable condition so that the substance, upon hardening thereof, forms a solid column which is able to support the roof.

An arrangement (i.e. system) for supporting a roof, particularly a roof of an underground excavation such as a mine, may comprise a hollow prop casing composed of at least two telescopable sections which can be telescoped apart subsequent to erection of the prop casing so as to bear upon the roof and a floor beneath the same, means for arresting the sections in telescoped-apart condition, and means for filling the prop casing with a hardenable substance in flowable condition so that the substance, upon hardening thereof, forms a solid column able to support the roof.

The prop casing thus has no supporting function per se, acting only as a receptacle for the hardenable substance, the supporting function being carried out by the hardenable substance when the same has hardened and forms a solid column within the prop casing. For this reason the prop casing can be made of relatively lightweight and inexpensive material, for instance synthetic plastic material such as polyvinylchloride or polyethylene, or even of a heavy grade of cardboard the inner surface of which is coated (e.g. with a foil of such synthetic plastic material as polyvinylchloride or polyethylene) to prevent the cardboard from disintegrating under the influence of the filler substance while the same is still in flowable condition.

The filler substance itself may be a concrete slurry, i.e. a mixture of water and a quick-binding cement, preferably in form of cement powder. Aggregate is preferably added (it may already be accommodated in the prop casing before the slurry is admitted into the same) to further increase the strength of the column being formed. In lieu of, or in addition to the aggregate, the prop casing may also contain at least some of the cement powder which is ultimately required to make the slurry. Other materials are also suitable for the hardenable substance, for example gypsum which again is preferably reinforced with aggregate, or a two-component adhesive system of synthetic plastic material which, when the two components are admixed with one another, will harden and form the requisite solid column. Here, again, it is preferably if aggregate is employed in addition, to become embedded in the two-component system so as to further reinforce the same. The aggregate can be in form of gravel or the like as is known from the construction industry. If gypsum is used, some or all of the gypsum powder required to form the solid column may already be contained in the hollow prop casing before water is admitted into the same, and if a two-component adhesive system is used one of the two components may already be wholly or in part accommodated in the hollow prop casing before the other component is admitted into the same. The aggregate may be admitted from outside during admission of the other component, or of the water, but preferably will already be present in the interior of the prop casing at this time.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. 7–9 are illustrations showing arrangements which permit the prop casings and/or the prop casings with the contents thereof, to be installed so that they can yield somewhat, to axial stress, or to be subjected to stress until the contents have hardened.

DESCRIPTION OF THE PREFERRED EMBODIMENTS

The invention will now be discussed jointly with respect to its method and apparatus (system) aspects, on hand of the appended Figures.

Figure 1:
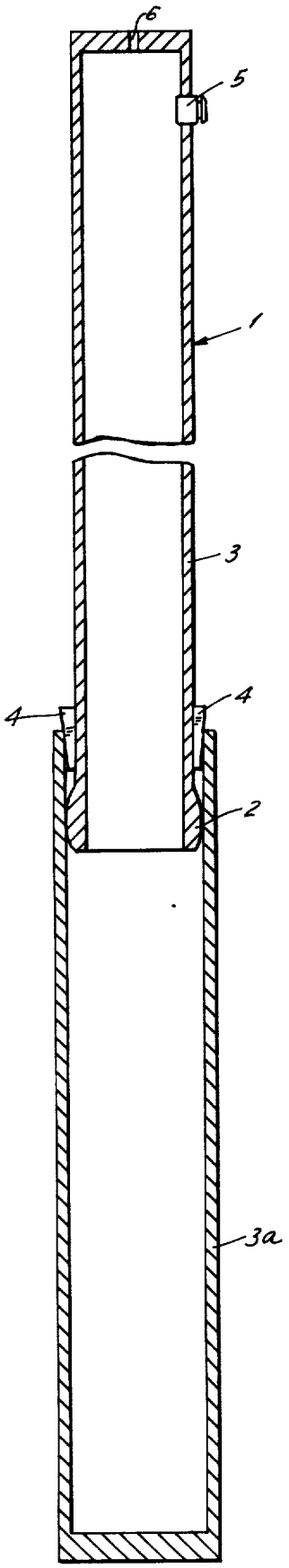
FIG. 1 is a somewhat diagrammatic vertical section through a prop casing according to the present invention.

FIG. 1 shows a prop casing according to the present invention. The apparatus or system according to the present invention can have any desired number of these prop casings 1, the specific number to be employed evidently depending upon the size of the roof area to be supported and the downward thrust of the rock strata which is to be contained. As FIG. 1 shows the prop casing 1 according to the invention comprises a lower telescopable tubular section 3*a* having a closed bottom wall and an upper telescopable section 3 having a closed top wall and which is telescopically received within the section 3*a*. A seal 2 in form of a bead or the like is provided at that end of the section 3 that is located within the section 3*a*; it need only prevent the escape of a relatively thick slurry, such as a concrete slurry or the like, and must of course permit telescoping of the section 3 relative to the section 3*a*. The upper end wall of the section 3 (or the circumferential wall of the section 3 adjacent the upper end wall) is provided with one or more vent openings 6 (one shown) to permit the escape of air which is being displaced as hardenable substance is admitted into the interior of the prop casing 1.

Figure 2:
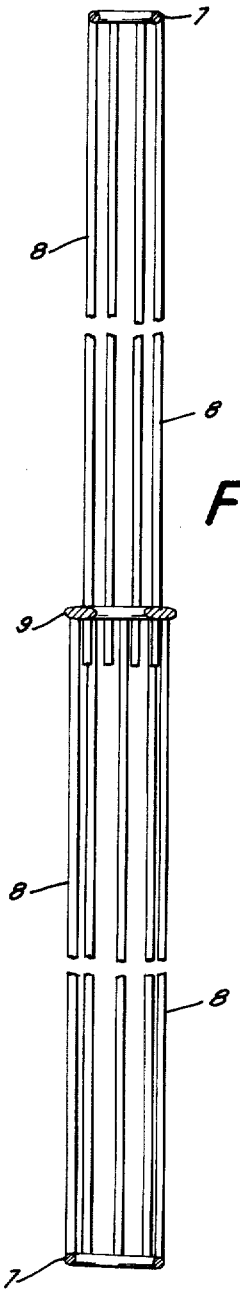
FIG. 2 is a side view of a telescopable reinforcing structure for use in the prop casing of FIG. 1.
Figure 2A:
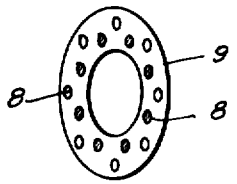
FIG. 2A is a top-plan view of the bottom portion of the reinforcing structure in FIG. 2.

When the prop casing is to be used, it is placed in upright position and the section 3 is telescoped out of the section 3*a* until the upper end wall of the section 3 bears against the roof to be supported. In this position the sections 3, 3*a* are arrested with reference to one another by suitable means, for example by means of the illustrated wedge 4 which is driven into the gap between them. It should be remembered that the sections 3, 3*a* are light in weight so that no great effort is required to hold them in the telescoped-apart position. Thereafter, the hardenable substance in flowable condition (e.g. one of the substances mentioned earlier) is admitted through a valve 5 which is mounted in the section 3 and which will be described later with reference to FIG. 4, until the interior of the prop casing 1 in FIG. 1 is completely filled with the substance. As mentioned before, aggregate and/or some of all of one of the two components making up the hardenable substance (e.g. water and cement powder; water and gypsum powder; two-component synthetic material) may already be present in the interior of the prop casing 1 before filling via the valve 5 is commenced. The presence of the vent 6 assures that the air can properly escape and not interfere with the hardening of the hardenable substance and its formation of a solid column of proper density. Of course, it will be understood that under all circumstances the material and construction of the prop casing 1 must be such that the hardenable substance can be admitted under a certain amont of pressure to assure proper filling of the casing. The strength and supporting ability of the solid column which subsequently forms in the casing 1 can be further increased by disposing in the casing 1 a reinforcing arrangement, analogous to the type of arrangements used in a reinforced concrete. Such an arrangement must also be telescopable to accommodate itself to changes in the length (height) of the prop casing as the sections 3, 3*a* are telescoped apart. The reinforcing arrangement can be in form of steel wire mesh or the like. FIGS. 2 and 2A show an arrangement which is especially suitable and which is in form of two "baskets" that are arranged in the sections 3 and 3*a*, respectively. Each of these baskets may have a ring element 7 to which an annulus of axially projecting steel rods or bars 8 is secured, e.g. by welding or the like. The free end portions of the bars 8 of one of the cages, here the lower one, are provided with eyelets or rings 9 (which are either welded to the free end portions or which may be formed by simply bending the free end portions to a requisite shape) and the rods 8 of the other cage slidably extend through these eyelets so that the overall length of the arrangement in FIG. 2 can be simply changed by telescoping the two baskets apart or together. The purpose of this arrangement is to reinforce the solid column which is being formed and in which the rods 8 and rings 7 become embedded upon admission of the hardenable substance into the prop casing 1, particularly to reinforce it against yielding in transverse direction if forces act upon it from the roof in a direction which is not strictly axial of the prop casing 1. The rings 7 may be suitably secured to the end walls of the sections 3, 3*a* for example by welding to them.

Figure 3:
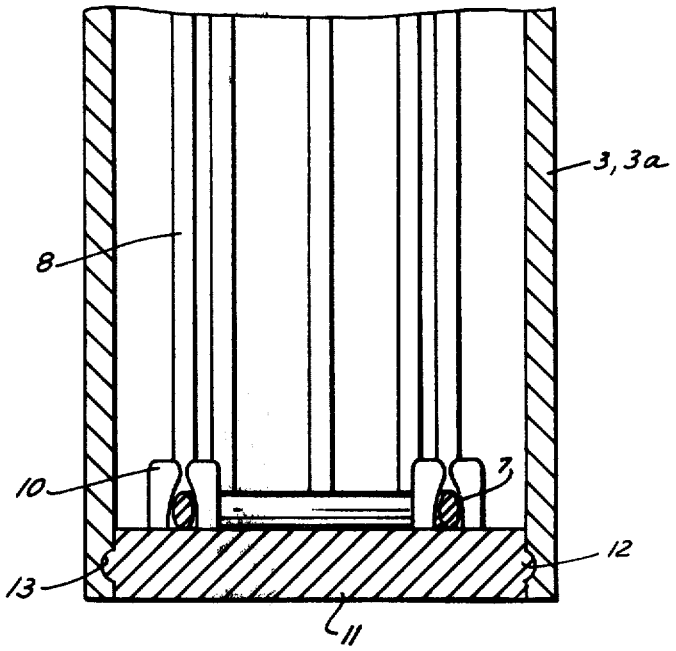
FIG. 3 is a fragmentary vertical section through the lower portion of a prop casing analogous to the one shown in FIG. 1 but representing a somewhat different embodiment.
Figure 3A:
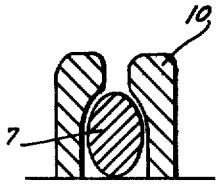
FIG. 3A is a detail sectional view of the ring within the lower portion of the prop casing.

However, as shown in FIG. 3 it is also possible to provide the end walls with two concentric annuli 10 of somewhat yieldable material, e.g. synthetic plastic material, between which the respective rings 7 can be inserted with a snap action. Of course, instead of using circumferentially complete annuli it is also possible for each annulus to be composed of a plurality of circumferentially relatively short sections 10 which are arranged to have the rings 7 snap between them. Particularly if the sections 3, 3*a* are made of synthetic plastic material it is advantageous if they simply have respective open ends each provided with an internal circumferential groove 13, and if the end walls 11 (one shown in FIG. 3) are separate elements provided with a circumferential bead 12 which can be inserted into this groove 13 with a snap action. In such a case the annuli 10 may then be of one piece with the respective end wall 11, as shown in FIG. 3.

Figure 4A:
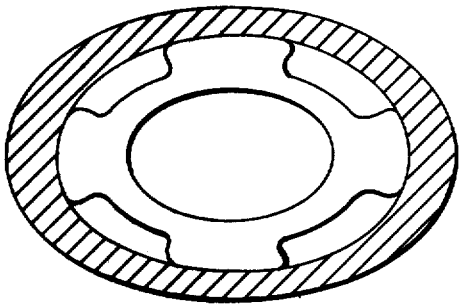
FIG. 4A is a fragmentary vertical section, showing a filler valve installed in a prop casing according to the invention.
Figure 4:
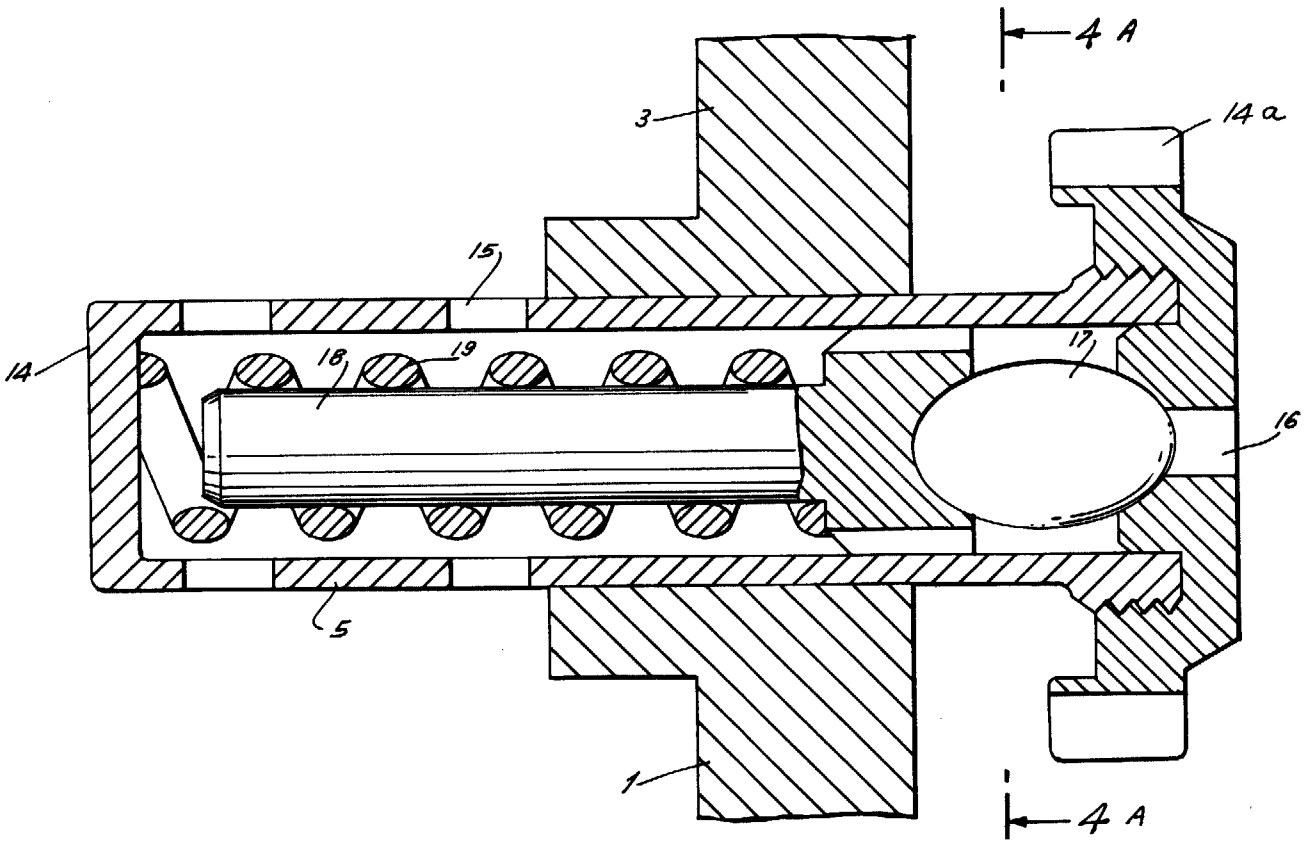

FIG. 4 shows the filter valve 5 of FIG. 1 in more detail. The valve is advantageously in form of a self-contained unit having a housing 14 which is secured in an appropriate opening of the circumferential wall of the section 3, e.g. by welding or by means of screw threads or the like. A portion of the housing projects to the outer side of the section 3 and is there provided with a collar 14*a* which preferably is circumferentially complete but could also be circumferentially interrupted. The portion of the housing 14 which projects inwardly of the section 3 is provided with a plurality of openings 15 communicating its interior with the interior of the section 3 and hence also of the section 3*a*. An inlet opening 16 is provided in the outer end of the housing 14 and formed with a valve seat against which a valve member 17 (here shown to be spherical) is normally pressed by a spring 19 which acts upon a valve stem 18 but carries and guides the valve element 17. The valve 5 thus is a oneway valve, i.e. it permits the inflow of a substance which is fed to the opening 16 under pressure but prevents the outflow of substance from the interior of the section 3.

Figure 5:
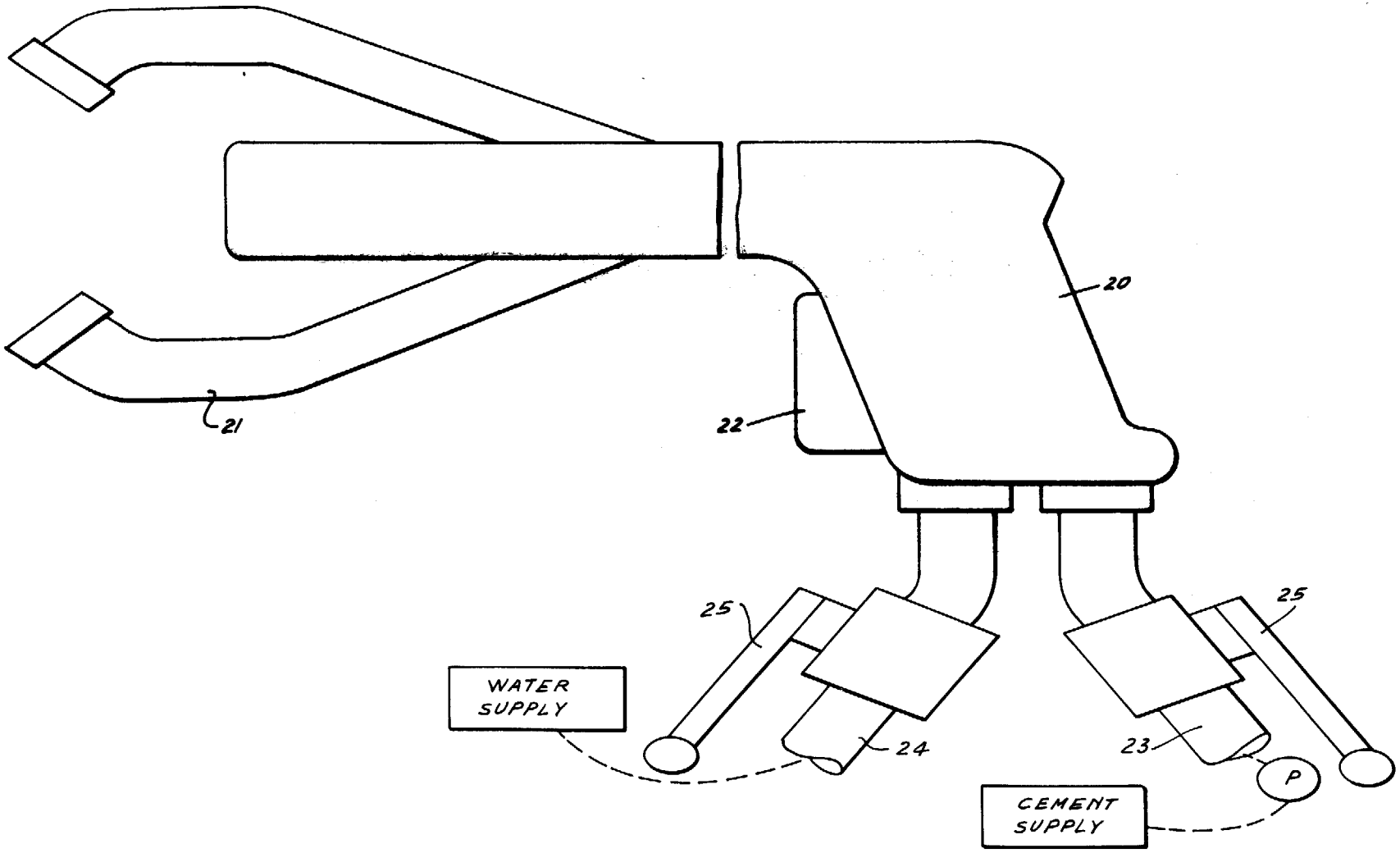
FIG. 5 is a somewhat diagrammatic view, showing a device for injecting hardenable substance into a prop casing according to the invention, together with the supply elements which cooperate with the device.

The admission of the substance is effected by means of an injecting device 20 which is shown in FIG. 5. This injecting device may (but need not be) pistol or gun-shaped and have a trigger 22 which, when depressed, permits flow of substance to the outlet opening of the device 20 (not shown) which in use is placed against the inlet opening 16. The device 20 is preferably provided with a pair of jaws 21 that can pivot apart from the position in FIG. 5 when the device is not in use, but which will pivot to the illustrated position and engage behind the collar 14*a* of the valve 5 when the device is to be used. Advantageously the jaws 21 are linked with the trigger 22 so that they pivot to the position in which they engage behind the collar 14*a* when the trigger 22 is depressed, thus holding the device 20 firmly coupled to the valve 5 for as long as a flow of substance from the device 20 into the valve 5 continues.

The device 20 is provided with connections to which a pair of conduits 23 and 24 is secured. The conduit 23 may have a pump P interposed in it which in turn draws pulverulent cement of the quick-bonding type (known from the construction industry and therefore requiring no detailed discussion) from the diagrammatically illustrated cement supply. The pump P may of course also be supplied with other materials, for example additives which aid in the rapid bonding of the cement, or such additives may be mixed in with the cement powder. The cement powder could be mixed with aggregate in which case the pump would have to be capable of transporting such aggregate in addition to the cement powder or a separate pump for the aggregate would have to be provided to supply it to the device 20. However, as mentioned before the aggregate may also be placed into the prop casing 1 as or before the same is erected, i.e. placed in upright position to bear against the roof to be supported. The conduit 24 communicates with the diagrammatically illustrated water supply, and a pair of valves 25, 25 are interposed in the respective conduit 23, 24 to permit regulation of the flow of the respective substances into the injecting device 20. The mixing of the substances may take place in the device 20 itself so that a slurry composed of the mixed substances issues from the outlet end of the device 20 and enters the inlet 16 of the valve 5. Evidently, if a two-component synthetic adhesive system is used, then one of the components could be supplied via the conduit 23 and the other component via the conduit 24. It is understood, of course, that the system (apparatus or arrangement) according to the present invention will also require either conduits or containers for the transport of the cement and water (or other components) to the working site. These are considered to be diagrammatically included in the illustration of the conduits 23, 24 and the cement and water supplies as shown.

It is also understood that the mixing of the components can take place within the respective prop casing 1, rather than in the device 20, if one or the other of the two components (e.g. water and cement; gypsum and cement; two-component synthetic plastic adhesive system) is already present in the prop casing 1 before the other component is admitted into the same via the valve 4.

It is also possible to provide an apparatus for mechanically telescoping the sections 3, 3*a* apart to the requisite extent, once they have been placed in upright position, and this apparatus or another apparatus may be utilized to press the wedges 4 in place so as to arrest the sections 3, 3*a* with reference to one another in the telescoped-apart position. Furthermore, apparatus may be provided for subjecting the prop casings 1 to vibrations in order to compact and densify the flowable substance admitted into them, e.g. the concrete slurry, so as to obtain a denser product which, when hardened, is able to withstand greater stresses.

Figure 6:
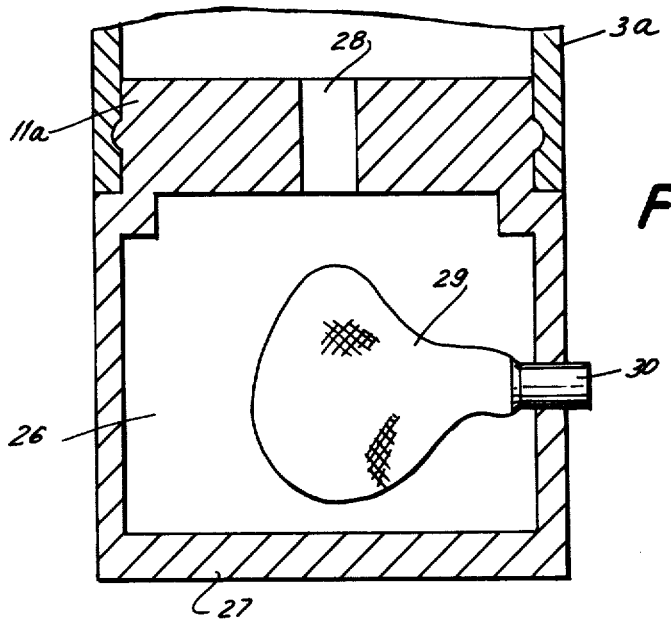
FIG. 6 is a fragmentary vertical section analogous to the one in FIG. 3, but illustrating still an additional embodiment of the invention.

In many instances it will be desirable or even necessary to remove one or more of the supports at a later date. If the supports are subjected to pressure from the roof, then they evidently cannot simply be taken away since they are firmly held between the roof and the floor. To make their removal nevertheless possible in a simple, inexpensive and rapid manner, an arrangement may be provided such as the one shown in FIG. 6. In this arrangement the bottom wall 11 of the lower section 3*a* (see FIG. 3) may be replaced with a casing 26 which is bounded by a wall 27 having a portion 11*a* that corresponds to the wall 11 of FIG. 3 and can be snapped in place in the lower open end of the section 3*a* as shown with reference to FIG. 3. The wall 11*a* has one or more holes 28 which communicate with the interior of the section 3*a* and with the interior of the casing 26, so that flowable substance admitted into the section 3*a* can enter the interior of the casing 26. The wall 27 is provided with an inlet nipple 30 and located in the interior of the casing 26, connected with the inlet nipple 30 to communicate with the same, is a bladder 29 which may be of deformable metal foil, of synthetic plastic material (e.g. polyvinylchloride, polyethylene), of fiber-reinforced synthetic plastic material or of a compound foil (synthetic plastic foil bonded to metal foil). The bladder 29 must be suitably supported in its interior against collapse by the flowable substance that enters the casing 26 through the hole 28; a metallic or synthetic plastic insert may be provided in its interior for this purpose. When the support is later to be removed a source of water or hydraulic fluid under very high pressure is connected to the nipple 30 and the fluid is admitted into the bladder 29. The pressure is so high that it bursts the bladder and the hardened substance surrounding the same, as well as the casing 26. It will be noted that the hardened substance in the casing 26 is not reinforced by the structure shown in FIGS. 2 and 2A so that the desired bursting effect can be achieved without problems. Once the casing 26 with its content of hardened substance has been burst in this manner, the support will simply fall down and can then be removed.

Figure 8:
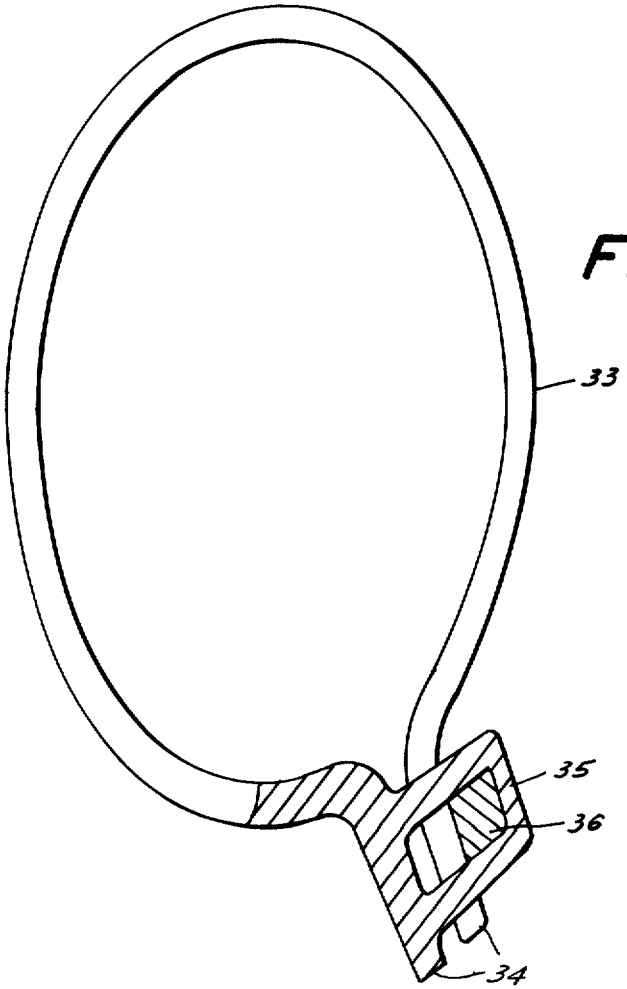

FIGS. 7–8 show that if it is desired for the finished support elements (i.e. the prop casings with the solid columns in them) to be somewhat yieldable under the pressure exerted by the roof—instead of being totally unyielding which might lead to their fractioning—the upper and/or lower sections of each prop casing may be provided with devices which afford such yielding. These devices may be tubes 31 which are slid over the respective sections 3 and/or 3*a* and which are formed with slits 32. Rings 33 are connected to the tubes 31 and provided with flanges 34 and a friction-type locking device composed of an eyelet 35 and a wedge 36. When installed and locked in place, these devices will resist pressure by the roof but will be able to yield to some extent if the pressure exceeds a certain selectable limit.

Finally, FIG. 9 shows that the prop casings may be provided on their sections 3 and/or 3*a* with devices 37, 38 which permit them to be placed under axial compressive stress (hydraulic cylinders may be used for this purpose) which can be maintained until the hardenable substance in the casings 1 has set and formed a solid supporting column.

It will be appreciated that the method and system according to the present invention make it possible to erect roof supports quickly and at low cost in virtually any location where there is a need for such supports, and that the erection is greatly facilitated due to the lightweight of the prop casings 1.

While the invention has been illustrated and described as embodied in an arrangement for supporting a roof of an underground excavation, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of supporting a roof, particularly a roof of an underground excavation such as a mine, comprising the steps of providing a hollow prop casing composed of at least two telescopable sections; erecting the prop casing and telescoping it apart until it bears upon the roof to be supported; arresting the sections of the prop casing in the telescoped-apart position; filling the prop casing with a hardenable substance in flowable condition so that said substance, upon hardening thereof, forms a solid column able to support said roof; and confining between a lower end of the prop casing and a floor against which the lower end bears, a mass of the hardenable substance which is formed with an internal void and with an inlet to the same so that, when the prop casing and column are later to be removed while subjected to pressure by the roof, said mass can be ruptured by admitting into said void a liquid under a pressure which is sufficiently high to effect such rupturing.

2. A method as defined in claim 1, wherein the step of filling comprises injecting the flowable substance under pressure into the prop casing.

3. A method as defined in claim 1, wherein the step of filling comprises injecting a viscous slurry of quick-hardening concrete into the prop casing.

4. A method as defined in claim 1; and further comprising the step of embedding reinforcements in said substance.

5. A method as defined in claim 4, wherein the step of embedding comprises disposing reinforcing elements within the hollow prop casing prior to the step of erecting the same, so that the reinforcing elements become surrounded by said substance when the prop casing is filled with the same.

6. A method as defined in claim 5, wherein the reinforcing elements are variable in length; and further comprising the step of varying the length of the reinforcing elements in conformity with the telescoping-apart of the prop casing.

7. A method as defined in claim 1, wherein the step of filling comprises forming a slurry from two components which, when mixed, harden to form said column, and admitting the slurry into the prop casing.

8. A method as defined in claim 7, wherein the prop casing has an inlet valve and the slurry is admitted into the prop casing under pressure via an injecting device which is releasably connectable to the inlet valve.

9. A method as defined in claim 8, wherein the components are water and cement powder and are fed separately to the injecting device and admixed therein to form the slurry to be admitted.

10. A method as defined in claim 9; and further comprising the step of regulating the rate at which the water and cement powder are fed to the injecting device.

11. A method as defined in claim 1, wherein the step of filling comprises injecting a viscous slurry of quick-hardening concrete into the prop casing; and further comprising the step of vibrating the slurry in the prop casing to compact the slurry.

12. A method as defined in claim 1, wherein the void is formed by confining an expansible bladder in said mass.

13. An arrangement for supporting a roof, particularly a roof of an underground excavation such as a mine, comprising a hollow prop casing composed of at least two telescopable sections which can be telescoped apart subsequent to erection of the prop casing so as to bear upon the roof and a floor beneath the same; means for arresting said sections in telescoped-apart condition; and means for filling the prop casing with a hardenable substance in flowable condition so that said substance, upon hardening thereof, forms a solid column able to support said roof, said filling means comprising a one-way inlet valve in one of said sections and including a housing having a passage provided with an inlet and an outlet which are respectively located outside and inside of said one section and a portion located outside said one section and provided with a collar, a valve member, and means normally biasing said valve member to a position in which it blocks said passage, said filling means further comprising an injecting device having holding members which are engageable with said collar so as to releasably retain said injecting device on said housing during filling of the prop casing, said holding members being claws which are movable relative to one another to and from a position in which they engage said collar.

14. An arrangement as defined in claim 13, said injecting device having a trigger which controls the flow of said material from said injecting device to said valve, and said holding members being movable to said position in response to depressing of said trigger.

15. An arrangement as defined in claim 14, said injecting device having at least two inlets; and further comprising conduit means communicating with said inlets for feeding water and quick-hardening cement powder to the respective inlets.

16. An arrangement as defined in claim 14, said injecting device having at least two inlets; and further comprising conduit means communicating with said inlets for feeding water and quick-hardening cement powder to the respective inlets so that the water and cement powder become mixed in said injecting device and form a slurry.

17. An arrangement as defined in claim 14; and further comprising valve means in said conduit means for regulating the flow of water and cement powder through the same.

18. An arrangement as defined in claim 15; and further comprising pump means connected to said conduit means for supplying said cement powder to the same.

19. An arrangement for supporting a roof, particularly a roof of an underground excavation such as a mine, comprising a hollow prop casing composed of at least an outer and an inner telescopable section which can be telescoped apart subsequent to erection of the prop casing so as to bear upon the roof and a floor beneath the same, said sections having sufficient strength to be self-supporting but not to support the roof; means for arresting said sections in telescoped-apart condition so that said prop casing constitutes a casting form which is held in position by bearing upon the roof and the floor; and means comprising a one-way inlet valve in said inner section for filling the prop casing with a hardenable substance in flowable condition so that said substance, upon hardening thereof, forms a solid column which by itself is able to support said roof, said one-way valve including a housing having a passage provided with an inlet and an outlet which are respectively located outside and inside said inner section, a valve member, and means normally biasing said valve member to a position in which it blocks said passage.

20. An arrangement as defined in claim 19, one of said sections having a portion located and telescopable in the other of said sections; and further comprising means for preventing the escape of the substance from between said sections while the mass is in flowable state.

21. An arrangement as defined in claim 19, wherein said sections are of a light-weight material.

22. An arrangement as defined in claim 19, wherein said sections are of synthetic plastic material.

23. An arrangement as defined in claim 19, wherein said arresting means comprises a wedge which is insertable between said sections.

24. An arrangement as defined in claim 19, wherein said outlet comprises a plurality of holes which communicate said passage with the interior of said prop casing.

25. An arrangement as defined in claim 19, said prop casing having an end portion which is located adjacent to the roof when said prop casing is in erected condition; and further comprising means in said end portion for venting air from said prop casing during filling of the same.

26. An arrangement as defined in claim 19, said substance comprising two components which, when mixed together, harden to form the solid column in said prop casing; and wherein said filling means further comprises an injecting device for injecting at least one of said components into said prop casing.

27. An arrangement as defined in claim 19, said substance comprising two components which, when mixed together, harden to form the solid column in said prop casing; and wherein said filling means further comprises an injecting device for injecting a mixture of said components with said prop casing, said injecting device having a pair of inlets for the respective components.

28. An arrangement for supporting a roof, particularly a roof of an underground excavation such as a mine, comprising a hollow prop casing composed of at least two telescopable sections which can be telescoped apart subsequent to erection of the prop casing so as to bear upon the roof and a floor beneath the same, said sections having sufficient strength to be self-supporting but not to support the roof; means for arresting said sections in telescoped-apart condition so that said prop casing constitutes a casting form which is held in position by bearing upon the roof and the floor; and means, including a one-way inlet valve in one of said sections for filling the prop casing with a hardenable substance in flowable condition so that said substance, upon hardening thereof, forms a solid column which by itself is able to support said roof, said one-way valve including a housing having a portion located outside said one section and provided with a collar, said housing having a passage provided with an inlet and an outlet which are respectively located outside and inside of said one section, said valve further including a valve member and means normally biasing said valve member to a position in which it blocks said passage, and said filling means further comprising an injecting device having holding members which are engageable with said collar so as to releasably retain said injecting device on said housing during filling of the prop casing.

29. An arrangement for supporting a roof, particularly a roof of an underground excavation such as a mine, comprising a hollow prop casing composed of at least two telescopable sections which can be telescoped apart subsequent to erection of the prop casing so as to bear upon the roof and a floor beneath the same, said sections having sufficient strength to be self-supporting but not to support the roof; means for arresting said sections in telescoped-apart condition so that said prop casing constitutes a casting form which is held in position by bearing upon the roof and the floor; means for filling the prop casing with a hardenable substance in flowable condition so that said substance, upon hardening thereof, forms a solid column which by itself is able to support said roof; and reinforcing means for reinforcing said substance upon filling of the same into said prop casing, said reinforcing means comprising length-variable reinforcing elements in said prop casing and being variable in length in correspondence with the telescoping of said sections, said reinforcing elements comprising a first set of rigidly connected reinforcing rods extending lengthwise in one of said sections, a second set of rigidly connected reinforcing rods extending lengthwise in the other of said sections, and means connecting each reinforcing rod of one set to a reinforcing rod of the other set for sliding movement relative thereto, each of said sections having an end wall which in use face said roof and said floor, respectively, and each of said sets including an annular member rigid with the respective reinforcing rods and connected to the respective end wall.

30. An arrangement for supporting a roof, particularly a roof of an underground excavation such as a mine, comprising a hollow prop casing composed of at least two telescopable sections which can be telescoped apart subsequent to erection of the prop casing so as to bear upon the roof and a floor beneath the same, said sections having sufficient strength to be self-supporting but not to support the roof; means for arresting said sections in telescoped-apart condition so that said prop casing constitutes a casting form which is held in position by bearing upon the roof and the floor; means for filling the prop casing with a hardenable substance in flowable condition so that said substance, upon hardening thereof, forms a solid column which by itself is able to support said roof; and means adjacent a free end of at least one of said sections projecting in part axially beyond the same and being yieldable to pressure acting lengthwise of the prop casing.

31. An arrangement as defined in claim 30, wherein the last-mentioned means further comprise means for selecting the pressure at which yielding is to occur.

32. An arrangement as defined in claim 31, wherein the last-mentioned means comprise friction-locking devices.

33. An arrangement for supporting a roof, particularly a roof of an underground excavation such as a mine, comprising a hollow prop casing composed of at least two telescopable sections which can be telescoped apart subsequent to erection of the prop casing so as to bear upon the roof and a floor beneath the same; means for arresting said sections in telescoped-apart condition; means for filling the prop casing with a hardenable substance in flowable condition so that said substance, upon hardening thereof, forms a solid column able to support said roof; and further comprising means for reinforcing said substance upon filling of the same into the prop casing, including length-variable reinforcing elements in said prop casing and being variable in length in correspondence with the telescoping of said sections, said reinforcing elements comprising a first set of rigidly connected reinforcing rods extending lengthwise in one of said sections, a second set of rigidly connected reinforcing rods extending lengthwise in the other of said sections, and means connecting each reinforcing rod of one set to a reinforcing rod of the other set for sliding movement relative thereto, each of said sections having an end wall which in use face said roof and said floor, respectively, and each of said sets including an annular member rigid with the respective reinforcing rods and connected to the respective end walls, said end walls being provided with grippers which engage the respective annular member.

34. An arrangement for supporting a roof, particularly a roof of an underground excavation such as a mine, comprising a hollow prop casing composed of at least two telescopable sections which can be telescoped apart subsequent to erection of the prop casing so as to bear upon the roof and a floor beneath the same, one of said sections having an open end which in use of the prop casing faces towards said floor; means for arresting said sections in telescoped-apart condition; means for filling the prop casing with a hardenable substance in flowable condition so that said substance, upon hardening thereof, forms a solid column able to support said roof; a hollow capsule mounted on said open end and having an interior communicating therewith so that said substance can enter into said interior; and an expansible bladder in said capsule and provided with an inlet accessible from the exterior of the capsule so that, when the prop casing and column are to be removed while under pressure from said roof, liquid can be admitted into the bladder under sufficient pressure to cause the bladder to rupture and to thereby burst the substance and the capsule.

35. An arrangement for supporting a roof, particularly a roof of an underground excavation such as a mine, comprising a hollow prop casing composed of at least two telescopable sections which can be telescoped apart subsequent to erection of the prop casing so as to bear upon the roof and a floor beneath the same; means for arresting said sections in telescoped-apart condition; means for filling the prop casing with a hardenable substance in flowable condition so that said substance, upon hardening thereof, forms a solid column able to support said roof; and means adjacent a free end of at least one of said sections projecting in part axially beyond the same and being yieldable to pressure acting lengthwise of the prop casing, including a tube section slipped onto the respective free end and provided with a slit, and a friction-locking ring cooperating with said tube section.

36. An arrangement as defined in claim 35, wherein said ring has flanges, and further comprising a friction-locking device including an eyelet cooperating with said flanges and a wedge cooperating with said eyelet and flanges for friction-locking the ring and tube section to said one section.

37. An arrangement for supporting a roof, particularly a roof of an underground excavation such as a mine, comprising a hollow prop casing composed of at least two telescopable sections which can be telescoped apart subsequent to erection of the prop casing so as to bear upon the roof and a floor beneath the same; means for arresting said sections in telescoped-apart condition; means for filling the prop casing with a hardenable substance in flowable condition so that said substance, upon hardening thereof, forms a solid column able to support said roof; and means including hydraulic cylinder means operative to apply pressure acting between said prop casing and at least said roof to maintain the prop casing in position until the hardenable substance has hardened.

* * * * *